US011539146B2

(12) United States Patent
Chieh et al.

(10) Patent No.: US 11,539,146 B2
(45) Date of Patent: Dec. 27, 2022

(54) CIRCULAR POLARIZED PHASED ARRAY WITH WIDEBAND AXIAL RATIO BANDWIDTH USING SEQUENTIAL ROTATION AND DYNAMIC PHASE RECOVERY

(71) Applicant: United States of America as respresented by the Secretary of the Navy, San Diego, CA (US)

(72) Inventors: Jia-Chi Samuel Chieh, San Diego, CA (US); Everly Yeo, San Diego, CA (US); Randall B. Olsen, Carlsbad, CA (US); Raif Farkouh, San Diego, CA (US); Maxwell M. Kerber, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/207,305

(22) Filed: Mar. 19, 2021

(65) Prior Publication Data

US 2022/0302603 A1 Sep. 22, 2022

(51) Int. Cl.
*H01Q 21/24* (2006.01)
*H01Q 21/00* (2006.01)

(52) U.S. Cl.
CPC ..... *H01Q 21/245* (2013.01); *H01Q 21/0006* (2013.01)

(58) Field of Classification Search
CPC .. H01Q 21/245; H01Q 21/0006; H01Q 1/125; H01Q 19/10; H01Q 3/2682;
(Continued)

(56) References Cited

U.S. PATENT DOCUMENTS 5,382,959 A 1/1995 Pett
5,541,366 A * 7/1996 Maoz ..... H05K 1/0313 29/829

(Continued)

FOREIGN PATENT DOCUMENTS

JP H03157006 A * 7/1991

OTHER PUBLICATIONS

Robert J. Mailloux; Electronically Scanned Arrays, Morgan & Claypool, 2007, pp. 20-21.
W. Choi, C. Pyo, J. Choi; "Broadband Circularly Polarized Corner-truncated Square Patch Array Antenna", IEEE APS Symposium, 2002, pp. 220-223.
K. Carver, J. Mink; "Microstrip Antenna Technology", IEEE Transactions on Antennas and Propagation, 1981, pp. 2-24.

(Continued)

*Primary Examiner* — Andrea Lindgren Baltzell
(74) *Attorney, Agent, or Firm* — Naval Information Warfare Center, Pacific; Kyle Eppele; James Eric Anderson

(57) ABSTRACT

A phased array antenna comprising: a substrate; a plurality of circular polarized wideband antenna elements disposed on the substrate, wherein each element comprises two orthogonal feeds; wherein the plurality of elements are organized into subarrays and physically oriented such that constituent elements of each subarray are sequentially rotated with respect to each other about respective axes that are perpendicular to a surface of the substrate so as to allow RHCP and LHCP transmission and reception; a phase shifter communicatively coupled to the feeds of all the elements and configured to electronically any dynamically compensate for phase regression or progression introduced by the sequential rotation of the elements without relying on physical transmission lines of different dimensions, and further configured to introduce a progressive phase shift across a beam steering plane to enable beam steering of the phased array antenna.

20 Claims, 13 Drawing Sheets

(58) Field of Classification Search
CPC .... H01Q 25/008; H01Q 19/06; H01Q 19/062; H01Q 21/24; H01Q 1/36; H01Q 21/065; H01Q 3/36; H01Q 3/40; H01Q 5/35; H01Q 7/005; H01Q 15/06; H01Q 15/08; H01Q 21/0025; H01Q 21/0093; H01Q 21/205; H01Q 21/22; H01Q 23/00; H01Q 25/02; H01Q 3/26; H01Q 3/32; H01Q 3/38; H01Q 3/42
See application file for complete search history.

(56) References Cited

U.S. PATENT DOCUMENTS

| | | | | |
|---|---|---|---|---|
| 5,661,494 | A * | 8/1997 | Bondyopadhyay | H01Q 1/364 343/700 MS |
| 8,350,771 | B1 * | 1/2013 | Zaghloul | H01Q 5/40 343/769 |
| 10,141,993 | B2 * | 11/2018 | Lee | H01Q 1/243 |
| 2009/0219219 | A1 * | 9/2009 | Pintos | H01Q 21/0006 343/853 |
| 2019/0326685 | A1 * | 10/2019 | Adams | H01Q 1/288 |

OTHER PUBLICATIONS

Nasimuddin, K. Esselle, A.K. Verma; "Wideband Circulariy Polarized Stacked Microstrip Antennas", IEEE Antennas and Wireless Propagation Letters, vol. 6, 2007, pp. 21-24.
P.S. Hall, "Application of sequential feeding to wide bandwidth, circularly polarized microstrip patch arrays", IEE Proceedings H, 1989, pp. 390-398.
S. Maddio; "A Compact Two-Level Sequentially Rotated Circularly Polarized Antenna Array for C-Band Applications" Hindawi Publishing Corporation, International Journal of Antennas and Propagation, vol. 2015, 2015.
A. Chen et al.; "Design of Multilevel Sequential Rotation Feeding Networks Used for Circularly Polarized Microstrip Antenna Arrays"; Hindawi Publishing Corporation, International Journal of Antennas and Propagation, vol. 2012, 2012.
S. C. Pavone et al.; "Design of Dual Circularly Polarized Sequentially-Fed Patch Antennas for Satellite Applications" Appl. Sci. 2020, 10, 2107.
A. A. Kishk; "Application of Rotated Sequential Feeding for Circular Polarization Bandwidth Enhancement of Planar Arrays With Single-Fed DRA Elements"; IEEE 0-7803-7846-6/03; 2003.

* cited by examiner

Boresight

| | | | |
|---|---|---|---|
| -270 $14_4$ | 0 $14_1$ | -90 $14_{16}$ | -180 $14_{13}$ |
| -180 $14_3$ | -90 $14_2$ | 0 $14_{15}$ | -270 $14_{14}$ |
| -90 $14_8$ | -180 $14_5$ | -270 $14_{12}$ | 0 $14_9$ |
| 0 $14_7$ | -270 $14_6$ | -180 $14_{11}$ | -90 $14_{10}$ |

-15 Degrees Phase Setting

| | | | |
|---|---|---|---|
| -270 $14_4$ | 45 $14_1$ | 0 $14_{16}$ | 0 $14_{13}$ |
| -180 $14_3$ | -45 $14_2$ | 90 $14_{15}$ | -90 $14_{14}$ |
| -90 $14_8$ | -135 $14_5$ | -225 $14_{12}$ | 180 $14_9$ |
| 0 $14_7$ | -225 $14_6$ | -90 $14_{11}$ | 90 $14_{10}$ |

30 Degrees Phase Setting

| | | | |
|---|---|---|---|
| -270 $14_4$ | 90 $14_1$ | 90 $14_{16}$ | 90 $14_{13}$ |
| -180 $14_3$ | 0 $14_2$ | 180 $14_{15}$ | 0 $14_{14}$ |
| -90 $14_8$ | -90 $14_5$ | -90 $14_{12}$ | 270 $14_9$ |
| 0 $14_7$ | -180 $14_6$ | 0 $14_{11}$ | 180 $14_{10}$ |

-45deg_AR -30deg_AR +0deg_AR
+15deg_AR +30deg_AR +45deg_AR

CIRCULAR POLARIZED PHASED ARRAY WITH WIDEBAND AXIAL RATIO BANDWIDTH USING SEQUENTIAL ROTATION AND DYNAMIC PHASE RECOVERY

FEDERALLY-SPONSORED RESEARCH AND DEVELOPMENT

The United States Government has ownership rights in this invention. Licensing and technical inquiries may be directed to the Office of Research and Technical Applications, Naval Information Warfare Center Pacific, Code 72120, San Diego, Calif., 92152; voice (619) 553-5118; ssc_pac_t2@navy.mil. Reference Navy Case Number 108687.

BACKGROUND OF THE INVENTION

All satellite communications in the microwave and millimeter-wave frequency bands require circular polarization for communications. Circular polarization is more resilient to scintillation through the atmosphere. There are two types of circular polarization, right hand circular (RHCP), and left hand circular (LHCP). For satellite communications, typically one is chosen for transmit and one is chosen for receive. The frequencies for transmit and receive could be the same, whereby time division duplexing is used, or they could be separate frequencies that are close in proximity, this is known as frequency division duplexing.

Phased array antennas are a class of antennas where the beam can be electronically steered. This is desirable especially as more constellations are deployed in LEO orbit. In LEO orbit, satellites can move overhead every 3-10 minutes, and so the ground antenna needs to constantly be changing its pointing angle. Also, in order to allow for smooth hand-over, the antenna must be able to slew quickly in order to not lose link. Previously, this was done with a two-antenna solution, where each antenna is mechanically steered because the antennas were not fast enough such that a single antenna can support the hand-over.

Generating circular polarization in antenna arrays is widely known, especially for microstrip type antennas. The main challenge for planar microstrip type antennas are (1) obtaining a wide impedance bandwidth (2) obtaining a wide axial bandwidth to preserve circular polarization, and (3) retaining good axial ratio across wide beam angles. Circular polarization can be obtained by exciting orthogonal modes and then recombining. Axial ratio is defined as the ratio between two perpendicular linear polarized signals. Typically, when the ratio is less than 3 dB, we consider the antenna to be circularly polarized. Zero dB would be ideal case, but in real life, asymmetries in the design, etc. limit how low this ratio can go. The Axial Bandwidth is then defined as the bandwidth for which the axial ratio is less than 3 dB. In typical microstrip antennas, the axial ratio bandwidth is very low. There is a need for an improved phased array antenna.

SUMMARY

Described herein is a phased array antenna comprising: a substrate, a plurality of circular polarized wideband antenna elements, and a phase shifter. The elements are disposed on the substrate. Each element comprises two feeds that are orthogonal to each other in order to generate RHCP and LHCP. The plurality of elements are organized into subarrays and physically oriented such that constituent elements of each subarray are sequentially rotated with respect to each other about respective axes that are perpendicular to a surface of the substrate so as to allow RHCP and LHCP transmission and reception. The phase shifter is communicatively coupled to the feeds of all the elements and configured to electronically and dynamically compensate for phase regression or progression introduced by the sequential rotation of the elements without relying on physical transmission lines of different dimensions. The phase shifter is further configured to introduce a progressive phase shift across a beam steering plane to enable beam steering of the phased array antenna.

Another embodiment of the phased array antenna is described as comprising a substrate, a plurality of circular polarized wideband antenna elements, a feeder network, and a phase shifter. The plurality of circular polarized wideband antenna elements are disposed on the substrate. Each element comprises two feeds that are orthogonal to each other in order to generate RHCP and LHCP. Each element has a center axis that is perpendicular to a surface of the substrate. The feeder network is coupled to the feeds. The plurality of elements are organized into triangular subarrays of three constituent elements each that are sequentially and respectively rotated about their respective center axes 0°, 120°, and 240° so as to allow RHCP and LHCP transmission and reception. Each subarray has a triangle centroid axis that is perpendicular to a surface of the substrate. The phase shifter is communicatively coupled to the feeds through the feeder network such that each feed has an equal path length to the phase shifter. The phase shifter is configured to electronically and dynamically compensate for phase regression or progression introduced by any phase offset in the feeder network and/or by the sequential rotation of the elements without relying on physical transmission lines of different dimensions. The phase shifter is further configured to introduce a progressive phase shift across a beam steering plane to enable beam steering of the phased array antenna.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The phased array antenna disclosed below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

References in the present disclosure to "one embodiment," "an embodiment," or any variation thereof, means that a particular element, feature, structure, or characteristic described in connection with the embodiments is included in at least one embodiment. The appearances of the phrases "in one embodiment," "in some embodiments," and "in other embodiments" in various places in the present disclosure are not necessarily all referring to the same embodiment or the same set of embodiments.

As used herein, the terms "comprises," "comprising," "includes," "including," "has," "having," or any variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or.

Additionally, use of words such as "the," "a," or "an" are employed to describe elements and components of the embodiments herein; this is done merely for grammatical reasons and to conform to idiomatic English. This detailed description should be read to include one or at least one, and the singular also includes the plural unless it is clearly indicated otherwise.

Figure 1A:
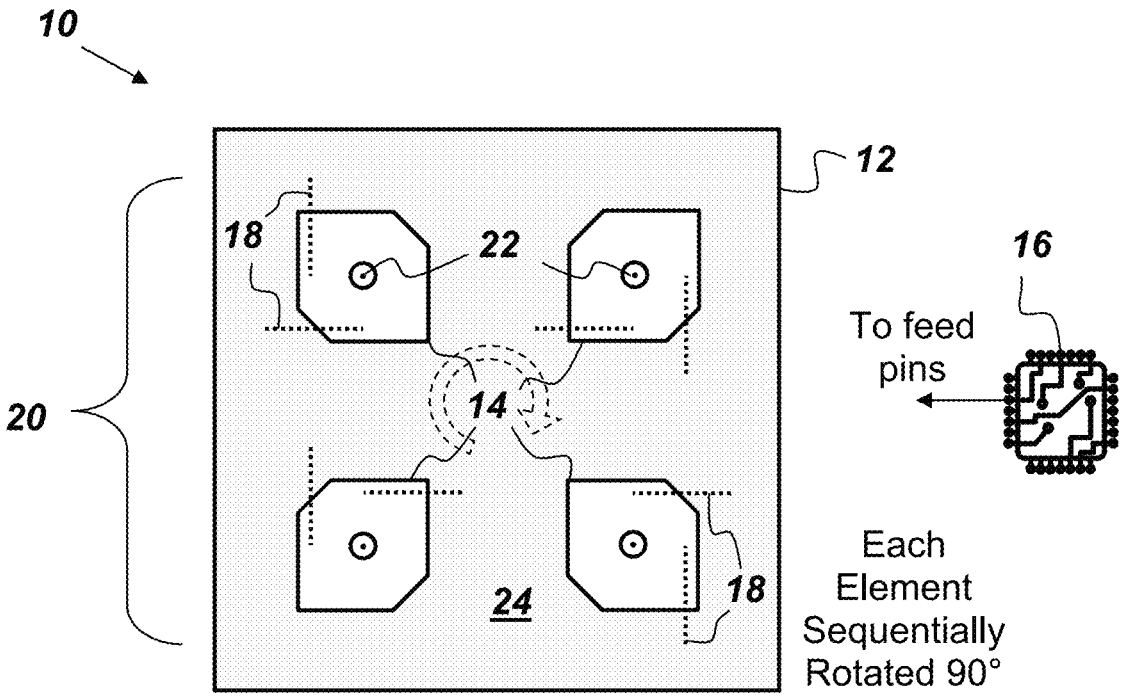
FIGS. 1A and 1B are respectively top and bottom views of an embodiment of a phased array antenna.
Figure 1B:
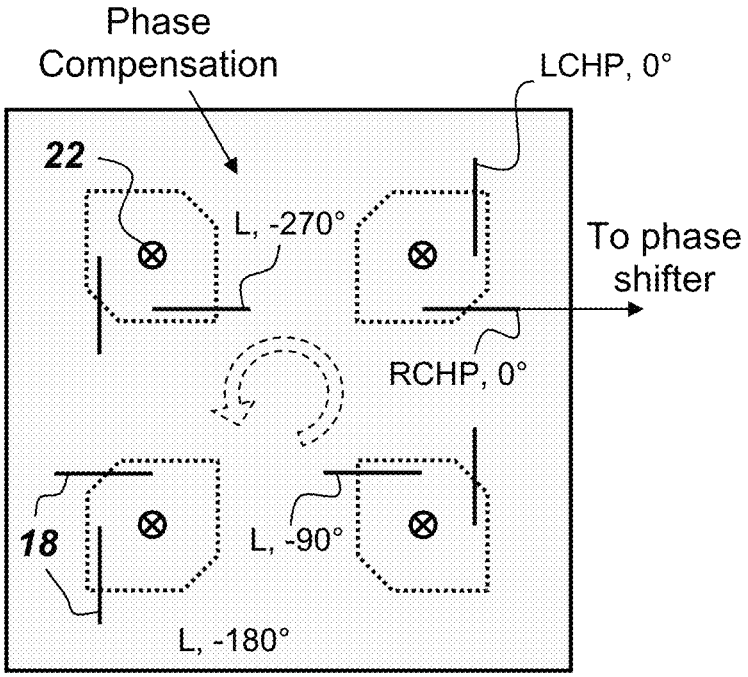

FIGS. 1A and 1B are respectively top and bottom views of an embodiment of a phased array antenna 10 that comprises, consists of, or consists essentially of a substrate 12, a plurality of circular polarized wideband antenna elements 14 (hereinafter referred to as elements), and a phase shifter 16. The elements 14 are disposed on the substrate 12. Each element 14 comprises two feeds 18 that are orthogonal to each other in order to generate RHCP and LHCP. The plurality of elements 14 are organized into subarrays 20. The elements 14 are physically oriented within each subarray 20 such that constituent elements 14 are sequentially rotated with respect to each other about respective axes 22 that are perpendicular to a surface 24 of the substrate so as to allow RHCP and LHCP transmission and reception. The phase shifter 16 is communicatively coupled to the feeds 18 of all the elements 14 and configured to electronically and dynamically compensate for phase regression or progression introduced by the sequential rotation of the elements 14 without relying on physical transmission lines of different dimensions. The phase shifter 16 is further configured to introduce a progressive phase shift across a beam steering plane to enable beam steering of the phased array antenna 10. The substrate 12 may be any dielectric material. Suitable examples of the substrate 12 include, but are not limited to, a closed-cell rigid expanded foam plastic based on polymethacrylimide such as the product Rohacell® manufactured by Evonik Industries AG of Essen, Germany, and Rogers 4350™ manufactured by the Rogers Corporation.

Two orthogonal modes may be created with an element 14 by using two feeds, such as feeds 18, each one orthogonal to the other. One of the feeds is delayed by 90° and the two are combined to create circular polarization. As opposed to introducing the delay through physical transmission paths of different lengths as done in the prior art, phased array antenna 10 utilizes the phase shifter 16 to achieve the appropriate phase delay. As can be seen in FIG. 1A, the elements 14 are arranged such that each element 14 is physically rotated by 90° compared to its next left neighbor. FIG. 1B shows, as an example, how LHCP may be achieved by adding a phase delay (e.g., 0°, 90°, 180°, and 270°) to the appropriate feed 18 of each element 14. This is known as sequential rotation, which enables narrow axial bandwidth elements to operate within an array that has wide axial bandwidth.

To allow for dual circular polarized operation, single-fed, circular-polarized, patch antenna elements 14 may be used. One example way to realize this is to introduce physical defects in the patch to excite circular polarization. This may be accomplished, for example, by truncating two diagonally-opposite corners of the patch (such as is shown in FIGS. 1A and 1B) or by introducing slots in the middle of the patch. It is to be understood that while patch antenna elements are shown in FIGS. 1A and 1B, the phased array antenna 10 is not limited to patch antenna elements. Element 14 may be any known antenna element capable of yielding circular polarization. Suitable examples of the elements 14 include, but are not limited to, Vivaldi antennas, Yagi antennas, dipole antennas, monopole antennas, bow tie antennas, and dual-linear polarized antennas. The elements 14 may all be of the same antenna type or a combination of different antenna types. Another way to allow for dual circular polarized operation may be to feed each antenna element 14 along the diagonal plane as is known in the art. Also, dual linear polarized antennas with hybrid couplers may be used to achieve dual circular polarization. The phased array antenna 10 uses the active portion of the array to do the phase compensation.

Still referring to FIGS. 1A and 1B, this embodiment of the phased array antenna 10 uses dual circular polarized antenna elements 14 that are oriented within an array of antennas in such a way that the EM waves are sequentially rotated in a desired direction to re-inforce circular polarization. A 2×2 subarray 20 shown in FIGS. 1A and 1B has local sequential rotation.

Figure 2:
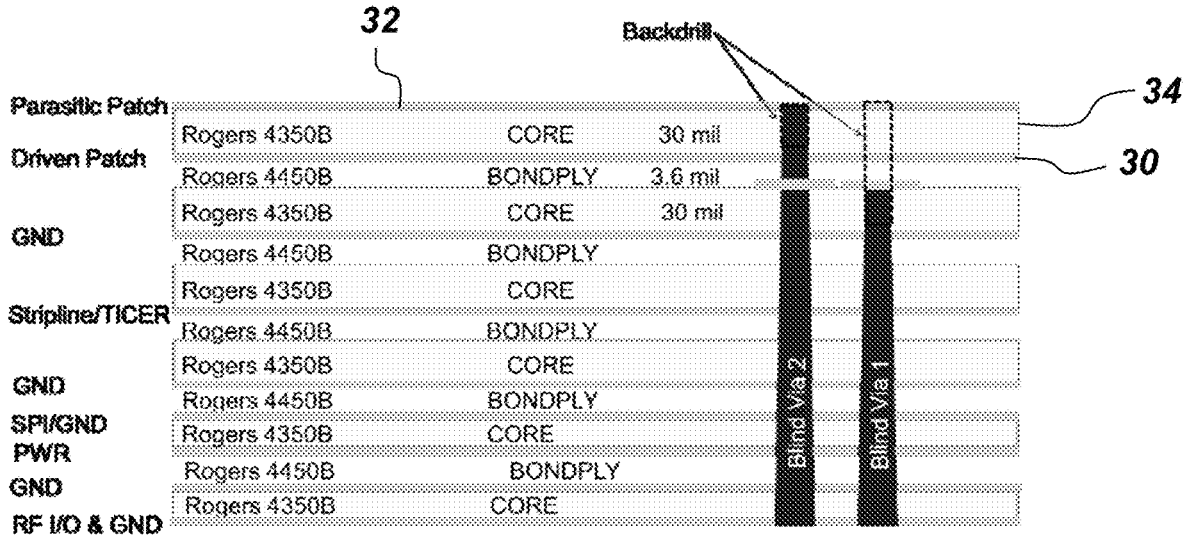
FIG. 2 is a side, cross-sectional-view illustration of an example stacked patch, single dual circular polarized wideband antenna.

FIG. 2 is a side-view illustration of an example stacked patch, single dual circular polarized wideband antenna embodiment of the element 14. A typical pin-fed patch antenna has an impedance bandwidth of maybe 5%. In order to obtain wider bandwidth, a stacked patch antenna may be employed. The pin feeds a "driven" patch 30, while the "driven" patch 30 is electromagnetically coupled to a "parasitic patch" 32 which is directly above it separated by a dielectric spacer 34. The thickness of the dielectric spacer 34 and the material from which it may be made are all design parameters that can be adjusted to suit a given application. In the embodiment shown in FIG. 3, the dielectric spacer is 30 mils thick and is made of a woven glass reinforced hydrocarbon/ceramic such as Rogers 4350B™ manufactured by the Rogers Corporation. Other suitable embodiments of the antenna element 14 are described in the paper, "A 28 GHz Dual Slant Polarized Phased Array using Silicon Beamforming Chipsets" by Jia-Chi Samuel Chieh et al. published in 2019 IEEE International Symposium on Phased Array System & Technology (PAST), which paper is incorporated by reference herein.

Referring back to FIGS. 1A and 1B, two opposite diagonal corners of each element 14 are truncated in order to force current to flow in a circular fashion around the patch to generate circular polarization. Each element 14 has two feeds 18, each orthogonal to each other in order to generate RHCP and LHCP. In this embodiment, the parasitic patch 32 and the driven patch 30 are designed such that the resonant frequencies are close together such that they overlap, in order to increase the impedance bandwidth. The dotted arrow shows the rotation progression. Since each element 14 in this embodiment is physically rotated by 90°, each element 14 requires appropriate phase compensation, which in this case is respectively 0°, −90°, −180°, and −270°. By arranging the subarray 20 in this fashion, circular polarization is coupled within each element 14, and is reinforced at the array level. This helps to widen the axial ratio bandwidth of the phased array antenna 10.

Figure 3:
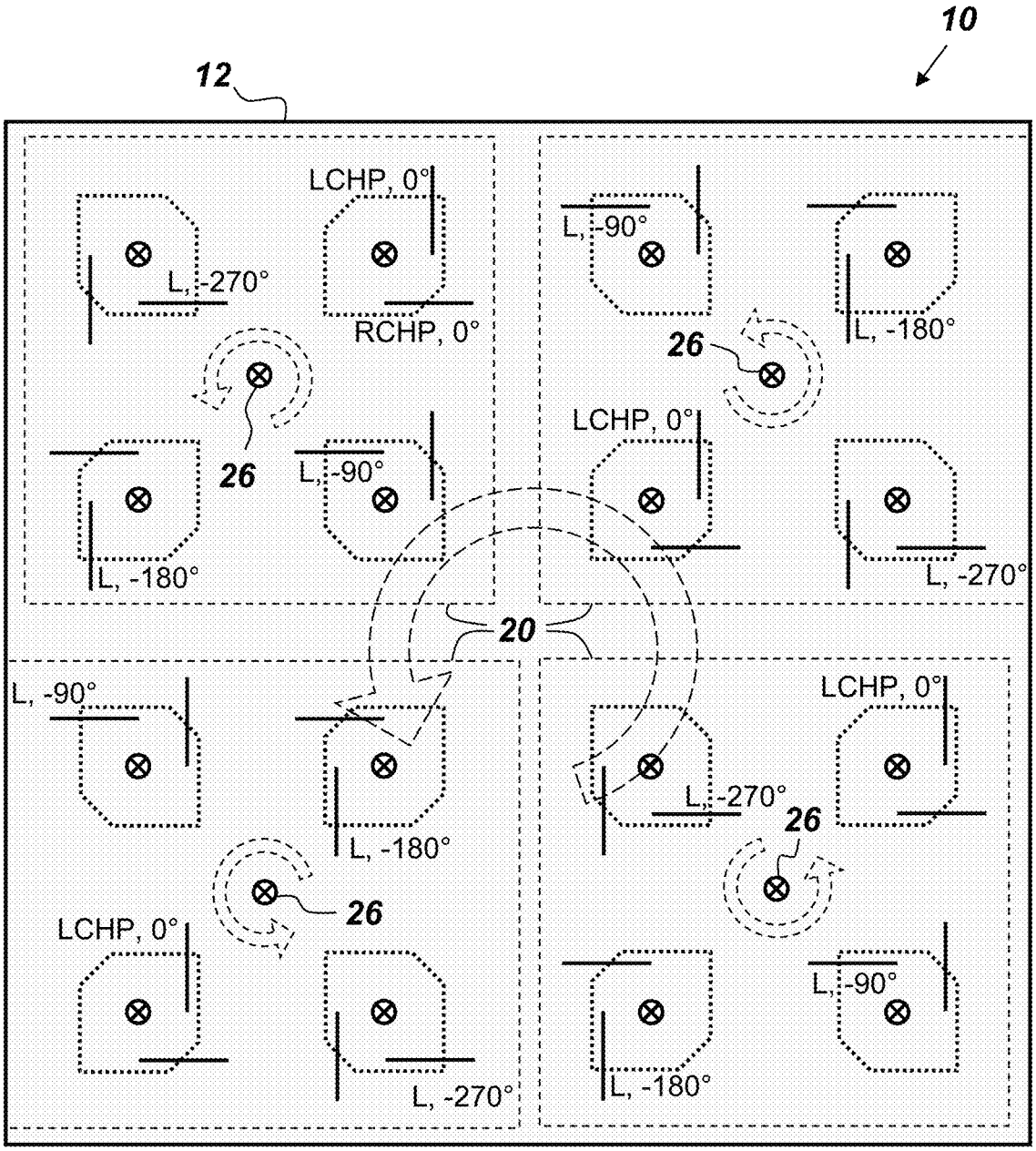
FIG. 3 is a bottom-view illustration of a 4×4 array embodiment of a phased array antenna.

FIG. 3 is a bottom-view illustration of a 4×4 array embodiment of the phased array antenna 10 that comprises four subarrays 20 such as depicted in FIGS. 1A and 1B. The 4×4 array has macro-level sequential rotation, such that each layer below has a nested sequential rotation cell. In order for the array to compensate for the physical orthogonal rotation of each element 14, the phase shifter 16 within the phased array 10 will compensate for the phase regression/progression introduced by sequentially rotating the elements 14. This is referred to as phase recovery. As shown in FIG. 2, the subarrays 20 are sequentially rotated with respect to each other about respective subarray axes 26 to create nested layers of rotation that reinforce circular polarization. Rotation may be achieved at the element level, subarray level, and whole array level. Different embodiments of the phased array antenna 10 may be implemented having only rotation at the element level, at the subarray level, and/or at the whole array level. One suitable embodiment of the phased array antenna 10 is described in the paper, J. -C. S. Chieh et al., "Development of Flat Panel Active Phased Array Antennas Using 5G Silicon RFICs at Ku- and Ka-Bands," in *IEEE Access*, vol. 8, pp. 192669-192681, 2020, doi: 10.1109/ACCESS.2020.3032841, which paper is incorporated by reference herein (hereinafter referred to as the *CHIEH* 2020 *PAPER*).

Figures 4A, 4B, 4C, 4D:
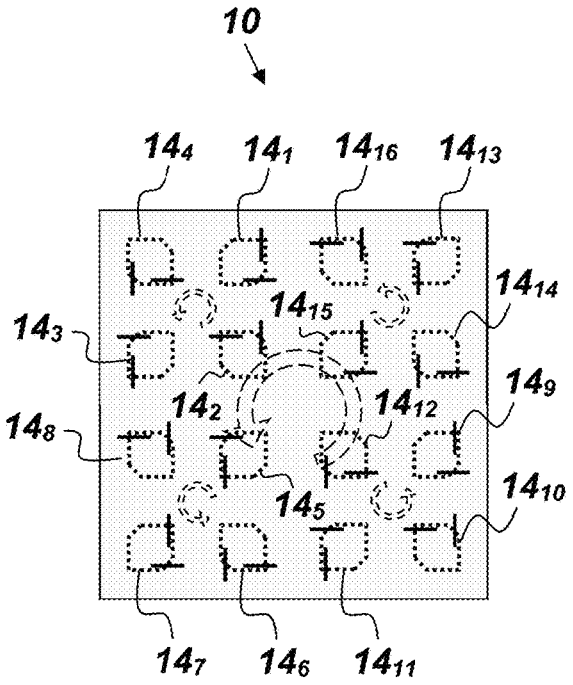
FIG. 4A is a bottom-view illustration of an example embodiment of the phased array antenna
FIGS. 4B-4D are matrices of different element phase settings for an example phased array antenna.

FIG. 4A shows an example embodiment of the phased array antenna 10. FIGS. 4B, 4C, and 4D illustrate different phase settings for the example phased array antenna 10 shown in FIG. 4A. FIG. 4B shows a corresponding phase excitation matrix for each of the 16-antenna elements 14 within the example phased array antenna 10 shown in FIG. 4A for a boresight pattern (i.e., without any beam steering). In order to beam steer, a progressive phase shift may be introduced across the beam steering plane (i.e., the substrate surface 24). For example, if the beam is to be steered in the azimuth plane (i.e., horizontal plane), then incremental phase shifts must be introduced across all elements in that plane. As used herein, the horizontal plane is synonymous with the azimuth plane and the vertical plane is synonymous with the elevation plane. This is the same with the vertical plane and diagonal planes. For simplicity, we will show examples for beam steering in the horizontal plane. FIG. 4C shows the element phase excitation for a −15° beam in the horizontal plane. Equation 1 below relates the beam steering angle (θ) with the progressive phase shift (φ) that is needed. For a −15 degree beam, a 45° progressive phase shift is required. For the example calculations that follow, the upper-left-most element in FIG. 4A (i.e., element $\mathbf{14}_4$) represents the reference element. It is to be understood that any element 14 can be chosen to be the reference element. As we move from left to right over the elements 14 depicted in FIG. 4A, each element 14 gets a 45° progressive phase shift. For example, element $\mathbf{14}_4$ gets a 45° phase shift, element $\mathbf{14}_{16}$ gets 90° phase shift and element $\mathbf{14}_{13}$ gets 180° phase shift. Elements $\mathbf{14}_4$, $\mathbf{14}_3$, $\mathbf{14}_8$, and $\mathbf{14}_7$ are the reference elements in this example since the beam is being steered horizontally to −15°.

$$\Delta\phi = \frac{360^\circ \cdot d \cdot \sin\theta}{\lambda} \qquad \text{(Equation 1)}$$

In Equation 1, Δφ represents the phase shift, d represents the space between two given elements 14, θ represents a beam steering angle, and λ represents an operating wavelength. FIG. 4D shows the element phase excitation for a −30° beam in the horizontal plane.

Vertical and diagonal beams can be generated as well, the unique progressive phase shifts can be determined by Equation 1 above. Because a progressive phase shift is necessary in order to steer the beam, this means that the phasing of the sequential rotation will be degraded as the beam is steered away from boresight. One would expect the axial ratio, therefore, to degrade as the beam is being steered away.

Figure 5A:
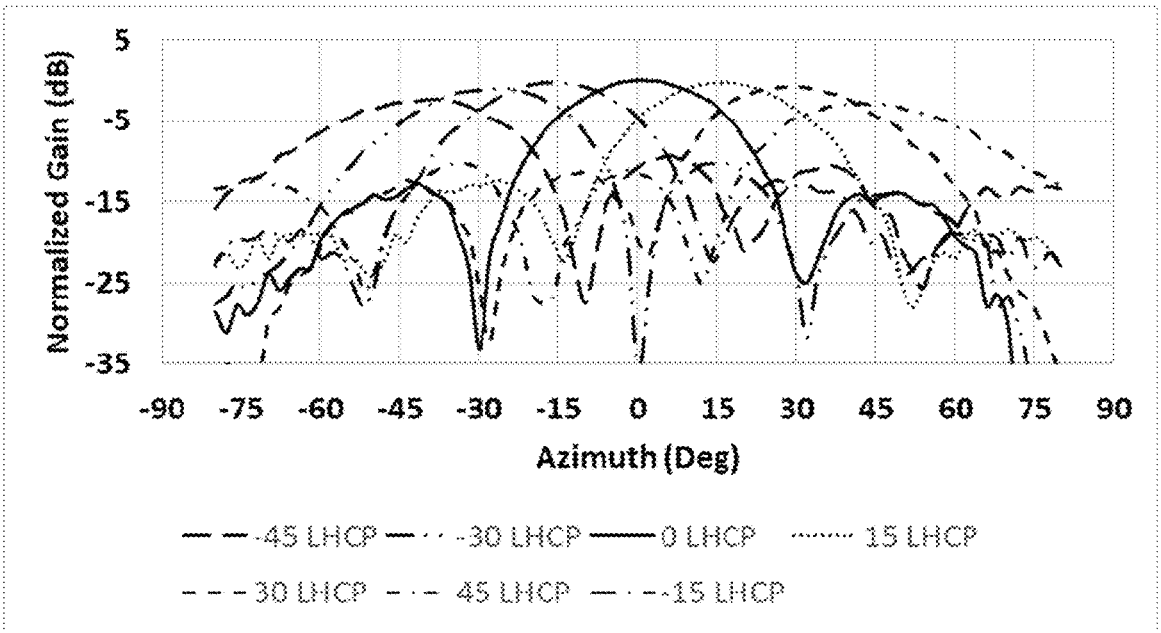
FIGS. 5A and 5B are plots of measured LHCP beam scan patterns.
Figure 5B:
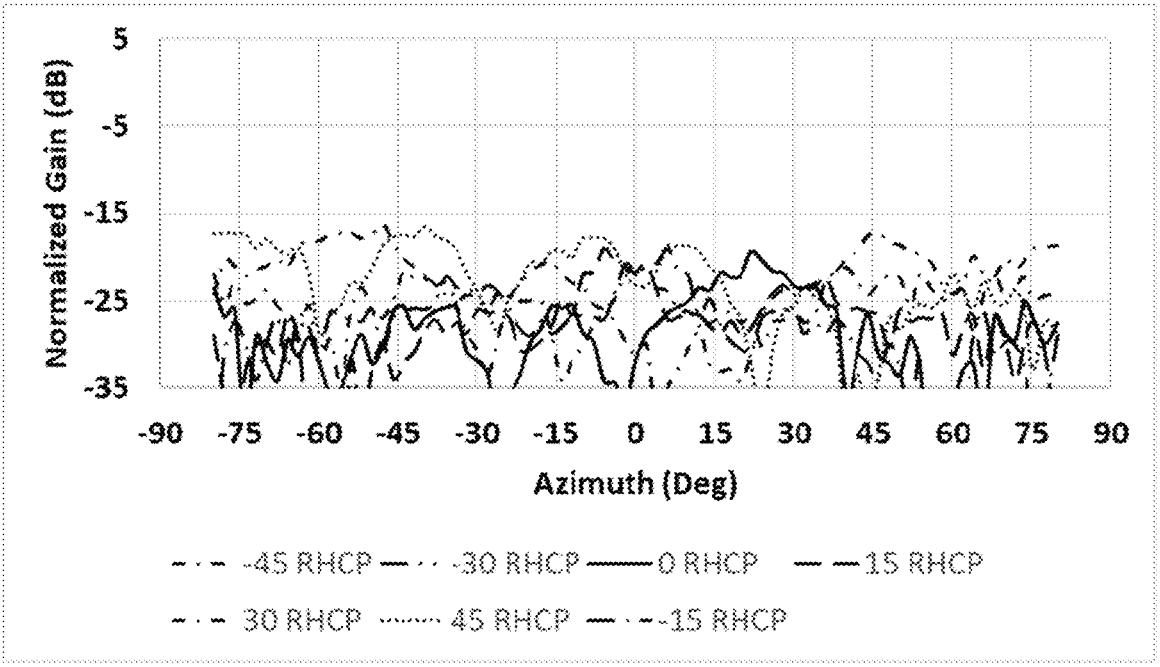

FIGS. 5A and 5B are plots of measured CP beam scan patterns in the Azimuth plane at 12.5 GHz for both LHCP and RHCP respectively for an embodiment of the phased array antenna 10. FIG. 5A is a plot of measured azimuth (x-z plane) beam scan patterns for the LHCP polarization at an operating frequency of 12.5 GHz. Measurements were performed up to ±80° due to constraints on the test setup in the anechoic chamber used by the inventors during the testing of one embodiment of the phased array antenna 10. As can be seen by comparing FIGS. 5A and 5B, the measured difference between the LHCP and RCHP over frequency and scan angle is approximately better than 20 dB showing that this embodiment of the phased array antenna 10 provides an array that is highly selective regarding the sense of the circular polarization.

Figure 6:
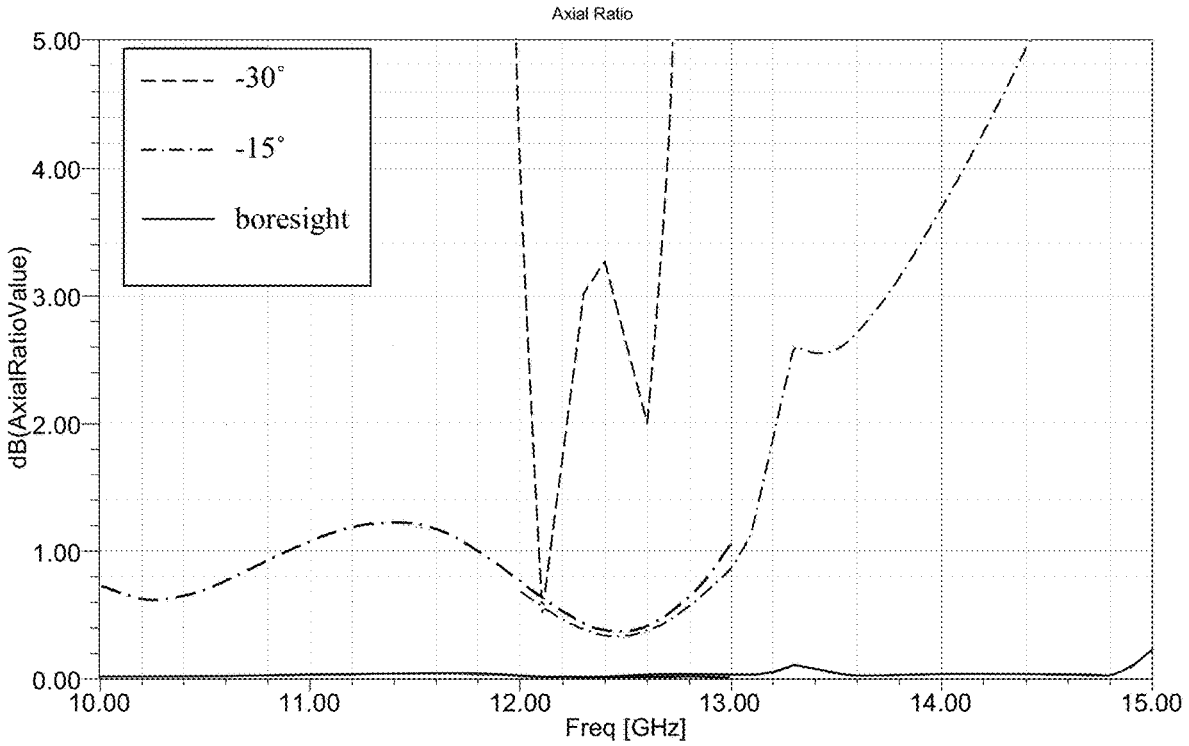
FIG. 6 is a plot of axial ratios over frequency of various beam steering angles for an embodiment of the phased array antenna.

FIG. 6 shows the axial ratio over frequency of the various beam steering angles for the embodiment of the phased array antenna 10 depicted in FIG. 4A. Sequential rotation of this embodiment of the phased array antenna 10 and subarrays 20 are most precise at boresight. The axial ratio at boresight is well below 0.5 dB. As the beam is steered away from boresight to −15°, the sequential rotation is no longer exact and the polarization purity suffers. The axial ratio at −15° is <3 dB from 10-14 GHz. As the beam is steered further away, the sequential rotation is somewhat degraded and the axial ratio at −30° is <3 dB from 12-12.6 GHz, a 600 MHz axial ratio bandwidth. This is still wider in axial ratio bandwidth for a given beam steering angle than any circular polarized phased array known to the inventors.

The phased array antenna 10 is a fully active antenna, the compensation for the sequential rotation is performed within the phase shifter 16, and therefore the phase delay is frequency dependent. The phase shifter 16 may be a radio frequency integrated circuit (RFIC) phase shifter. As the scan angle increases, the progressive phase shift also increases, disrupting the phase continuity of the sequential rotation of the phased array antenna 10. In all cases, the appropriate phase compensation due to the sequential rotation is introduced through a phase shifter 10. The phase shifter 16 may be any phase shifter capable of dynamically compensating for progressive phase shift of the phased array antenna 10. It is preferred that the phase shifter 16 be a fully integrated circuit (IC). The phase shifter 16 may be implemented on, for example, Silicon, Silicon Germanium, Gallium Arsenide, Gallium Nitride, or Indium Phosphide. A suitable example of the phase shifter 16 includes, but is not limited to, a highly integrated silicon core chip for active steerable antenna arrays intended for SATCOM, RADAR and TDD/FDD applications such as the AWMF-0117 Ku-Band Silicon Intelligent Gain Block™ manufactured by Anokiwave. Other suitable, non-limiting, examples of the phase shifter 16 are described in the *CHIEH* 2020 *PAPER*.

Figure 7:
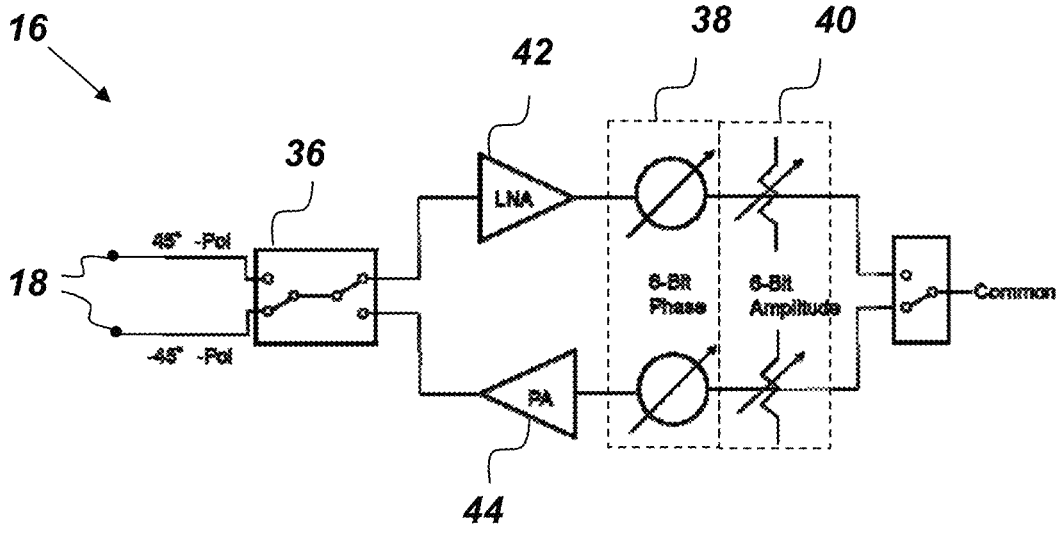
FIG. 7 is an illustration of a systems level schematic of an example embodiment of a phase shifter.

FIG. 7 shows a systems level schematic of an integrated beamformer embodiment of the phase shifter 16 integrated into a single-channel chipset. This embodiment of the phase shifter 16 allows for support of dual-polarization through a double-pole-double-throw (DPDT) transmit/receive (T/R) switch 36. When switching between the LHCP and RHCP, since nested SQR is used, the phase compensation applied through the phase shifter 16 is reversed. The switch 36 serves to shift between transmit and receive paths as well as switching between two polarizations. The phase compensations for the sequential rotation and progressive phase shift for beam steering are both implemented by the phase shifter 16. This embodiment of the phase shifter 16 further comprises 6-bit phase shifters 38, a variable gain amplifier 40, low noise amplifier 42, and power amplifier 44 all integrated within the same IC.

Figure 8:
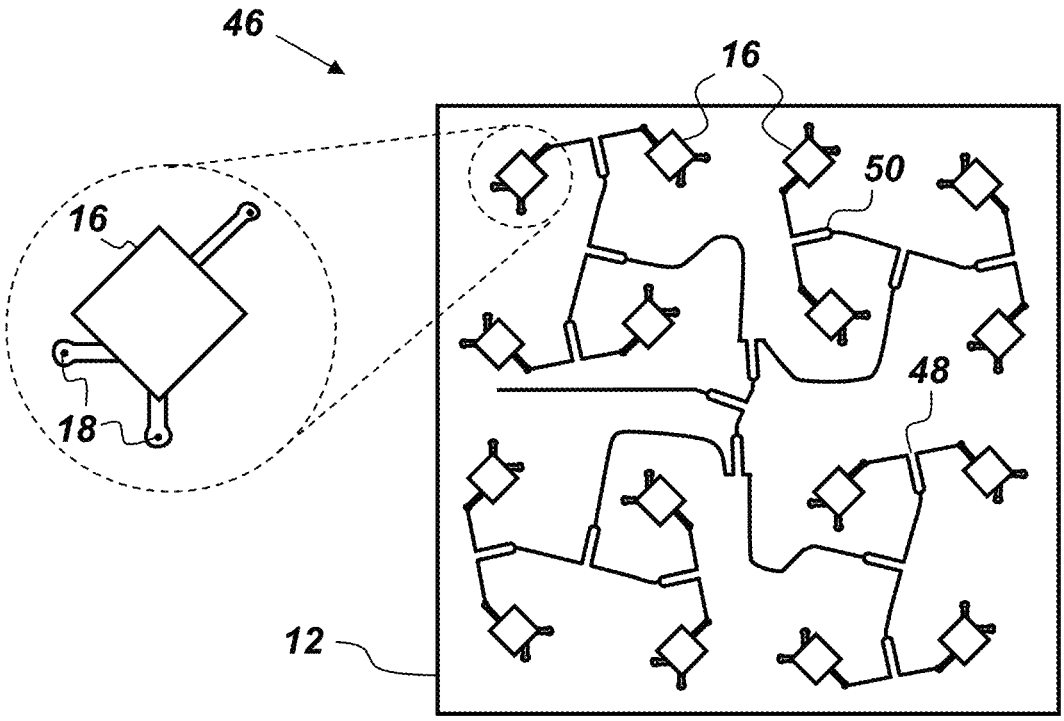
FIG. 8 is a top-view illustration of an embodiment of a feeder network.

FIG. 8 is an illustration of an example feeder network 46 disposed beneath the elements 14. In the embodiment shown in FIG. 7, each element 12 has a corresponding RFIC phase shifter 16. Even though efforts were made to design for equal path lengths of the feeder network 46, bends and curves were used, which can add to or subtract from the total phase. Any asymmetries in the feed such as bends could cause phase errors that would need to be compensated for in the phase shifter 16. The feeder network 46 may be implemented in a stripline layer made of transverse electromagnetic (TEM) transmission line medium. In one example embodiment, the feeder network 46 comprises NiCr foil resistors 48 connected to 3 dB Wilkinson power splitters 50. Wilkinson splitters/combiners are preferably used in the feeder network 46 in place of T-Junctions in order to mitigate any likelihood of the phased antenna array 10 oscillating. Each element 14 in this embodiment is fed through a via, which is back-drilled to disconnect it from the parasitic patch as shown in FIG. 2. The phase shifter 16 may be used to measure and characterize losses and gains from the whole RF chain, including the RFIC phase shifter 16, the RFIC to substrate 12 transition, feeder network 46, and transitions from the phase shifter 16 to each element 14. Various power, ground, and digital routing planes reside underneath the feeder network 46 to provide biasing and control to the phase shifters 16. Finite ground plane coplanar waveguide (FGCPW) may be used to route RF signals from the RFIC to the elements 14 and from the RFIC phase shifters 16 to the feeder network 46.

Figure 9:
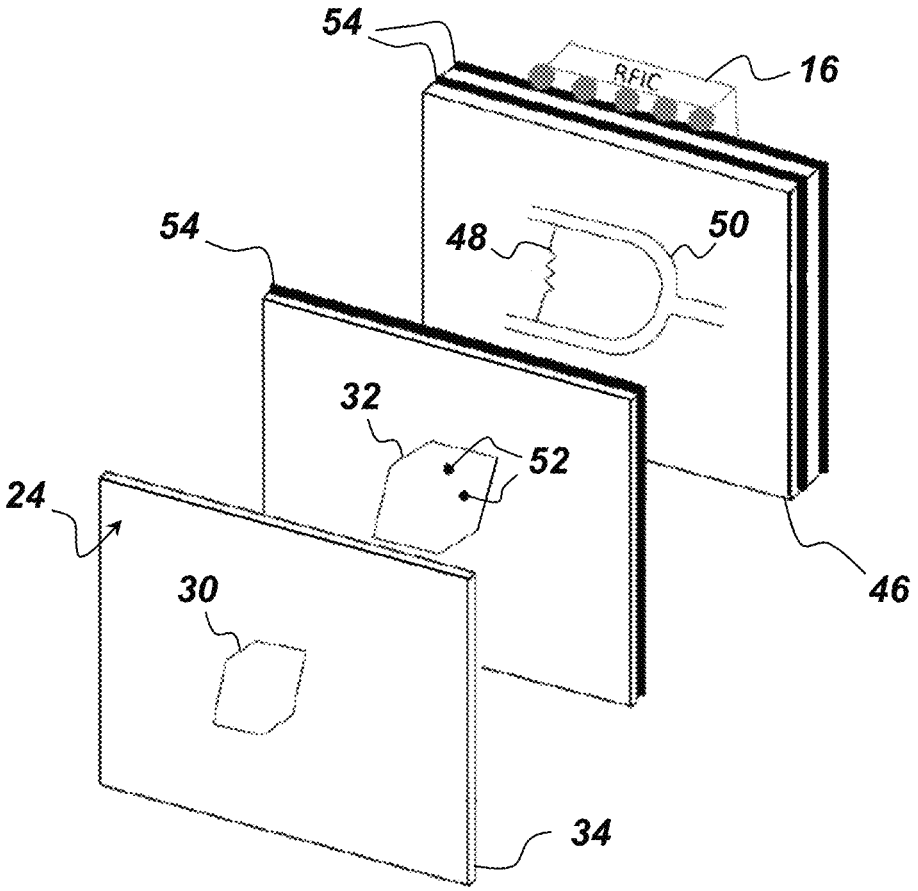
FIG. 9 is an exploded-view illustration of various elements of an embodiment of a phased array antenna.

FIG. 9 is an expanded view illustration of various elements of a stacked patch embodiment of the phased array antenna 10. In this embodiment, two blind vias 52 are used. One of the blind vias 52 is used to route RF signals to the driven patch element 30. The other blind via 52 is used to stitch ground vias around the stripline feeder network 46. In this embodiment, these blind vias 52 are back-drilled, filled with dielectric hole material, and then cap-plated as shown in FIG. 2. Back-drilling allows for a single copper plating cycle, resulting in finer tolerances and feature sizes on the printed circuit board (PCB) substrate 12. FIG. 8 also illustrates various ground layers 54.

Figure 10A:
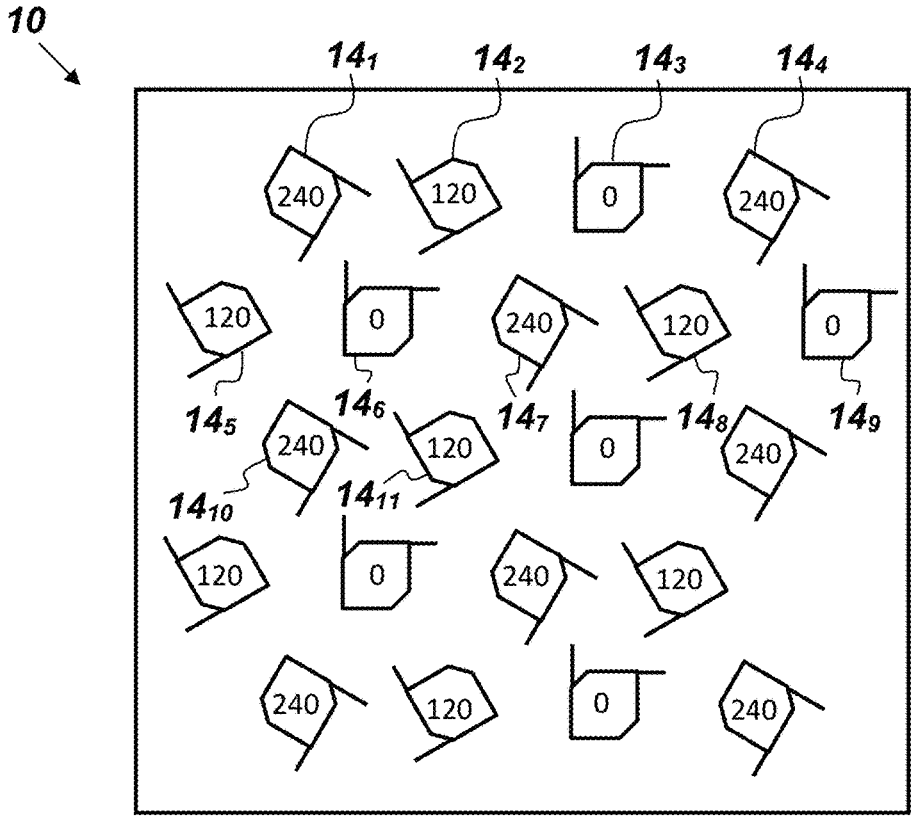
FIGS. 10A and 10B are top-view illustrations of an embodiment of a phased array antenna.
Figure 10B:
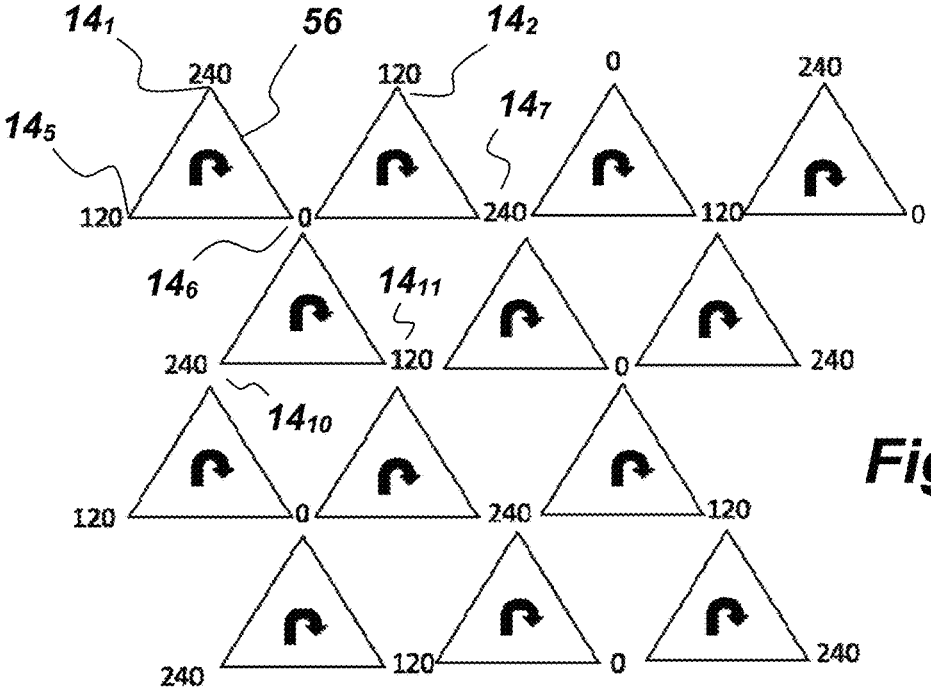

FIGS. 10A and 10B are illustrations of an embodiment of the phased array antenna 10 having a triangular lattice of sequentially-rotated elements 14. In this embodiment, each subarray 20 is triangular (hereinafter referred to as triangular subarrays 56), consisting of three elements 14 positioned with respect to each other as vertices of a triangular subarray 56. A triangular lattice configuration may be used to more efficiently fill a given aperture area of a given size while also allowing the ability to do a conical scan of +/−45° without grating lobes. In the embodiment of the phased array antenna 10 shown in FIGS. 10A and 10B, the triangular subarrays 56 are arranged with respect to each other to form a lattice where neighboring subarrays 56 share a common element 14 as a vertex. For example, element $\mathbf{14}_6$ forms a vertex for three different subarrays 56, specifically, the triangular subarray 56 formed by elements $\mathbf{14}_6$, $\mathbf{14}_5$, and $\mathbf{14}_1$, the triangular subarray 56 formed by elements $\mathbf{14}_6$, $\mathbf{14}_2$, and $\mathbf{14}_7$, and the triangular subarray 56 formed by elements $\mathbf{14}_6$, $\mathbf{14}_{11}$, and $\mathbf{14}_{10}$. In the embodiment of the phased array antenna 10 shown in FIG. 10A, the elements 14 are depicted as stacked patch antennas, but it is to be understood that this is only one embodiment of the phased array antenna 10 and that the elements 14 are not limited to patch antennas.

Figure 11A:
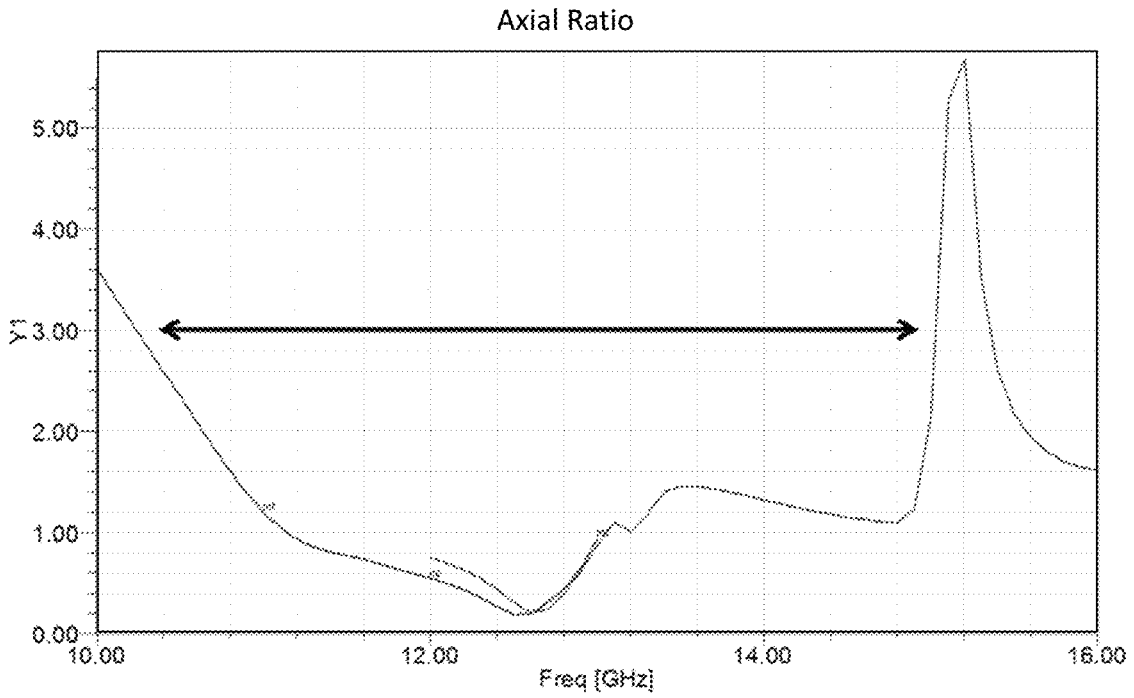
FIGS. 11A and 11B are plots of axial ratios for different embodiments of a phased array antenna.
Figure 11B:
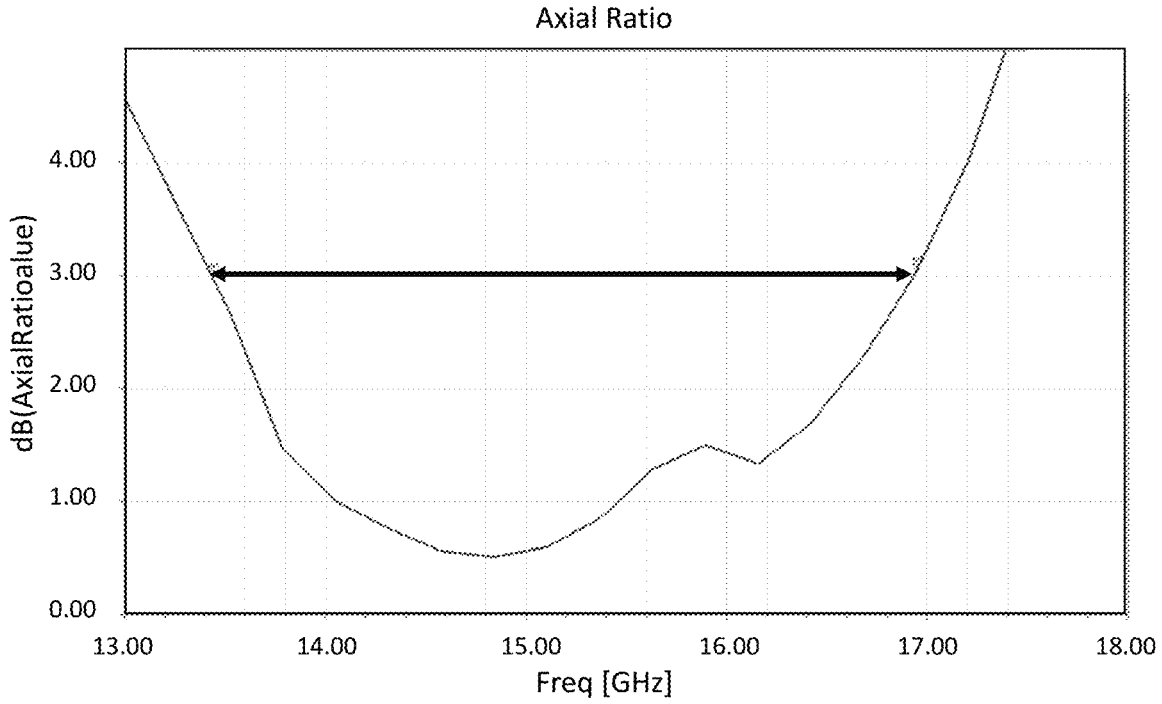

FIGS. 11A and 11B are respectively plots of the measured axial ratios of the 2×2 array embodiment of the phased array antenna 10 shown in FIGS. 1A and 1*b* and the triangular lattice embodiment of the phased array antenna 10 shown in FIG. 10A. The axial ratio bandwidth is indicated in both FIGS. 11A and 11B by a black arrow. As shown in FIG. 11A, the axial ratio bandwidth of the 2×2 array embodiment of the phased array antenna 10 is quite large: 10.2-14.4 GHz, 4.2 GHz wide. The axial ratio bandwidth for the triangular lattice embodiment of the phased array antenna 10 is also quite large: ~13.41-~16.86 GHz, 3.45 GHz wide, as can be seen in FIG. 11B.

Figure 12:
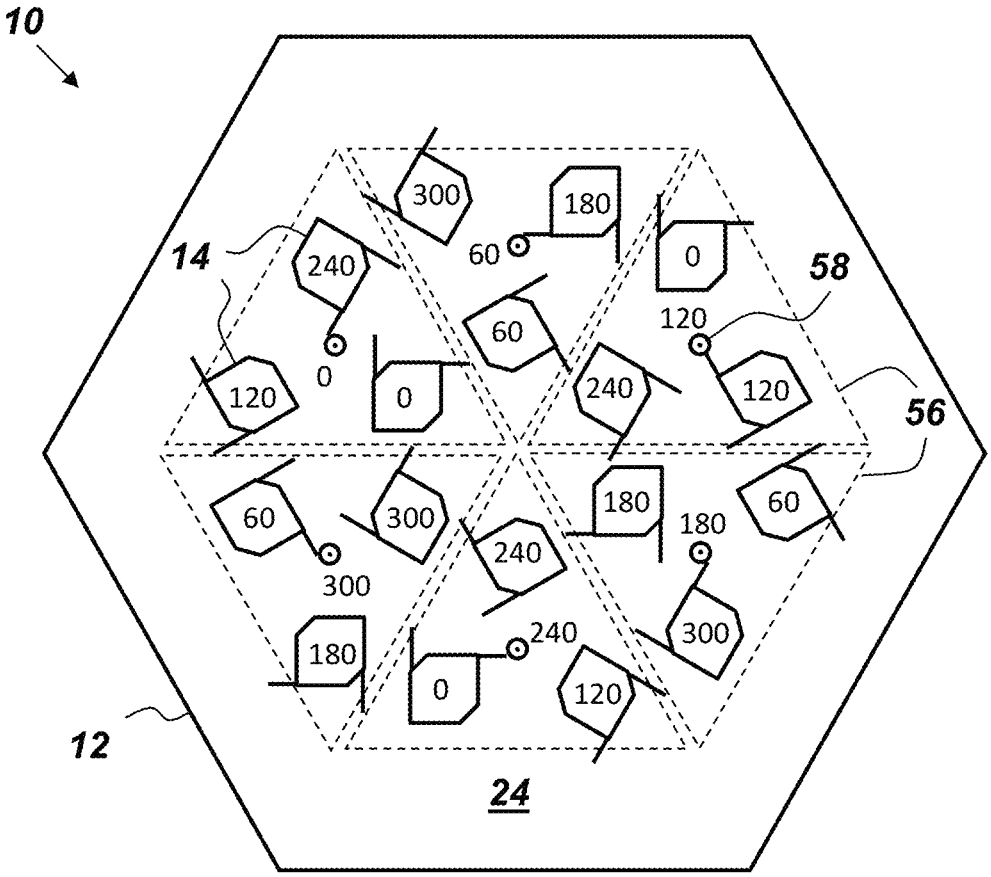
FIG. 12 is an illustration of an embodiment of a phased array antenna.

FIG. 12 is an illustration of an embodiment of the phased array antenna 10 where the plurality of elements 14 are organized into triangular subarrays 56, each having three constituent elements 14 that are sequentially and respectively rotated about their respective center axes 22 by 0°, 120°, and 240° so as to allow RHCP and LHCP transmission and reception. Also in this embodiment, each subarray 56 has a triangle centroid axis 58 that is perpendicular to a surface 24 of the substrate 12. In the embodiment of the phased array antenna 10 shown in FIG. 12, the six triangular subarrays 56 are sequentially and respectively rotated about their respective triangle centroid axes 38 by 0°, 60°, 120°, 180°, 240°, and 300° to create nested layers of rotation that reinforce circular polarization.

Figure 13A:
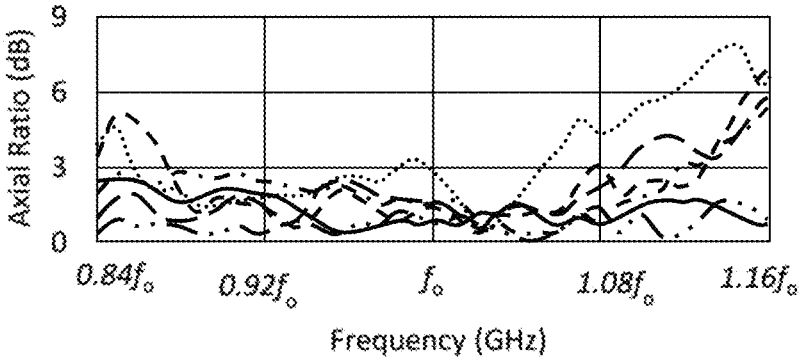
FIGS. 13A and 13B are plots of axial ratios.
Figure 13B:
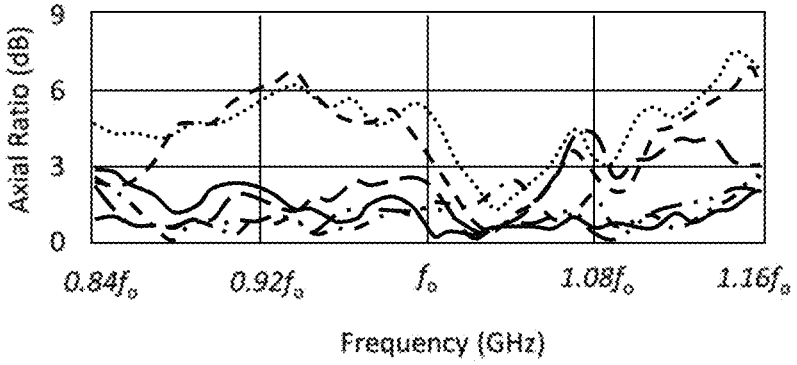
Figure 13C:
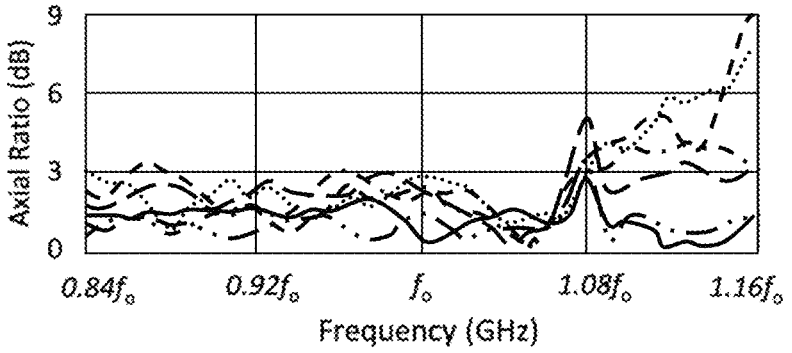
Figure 13D:
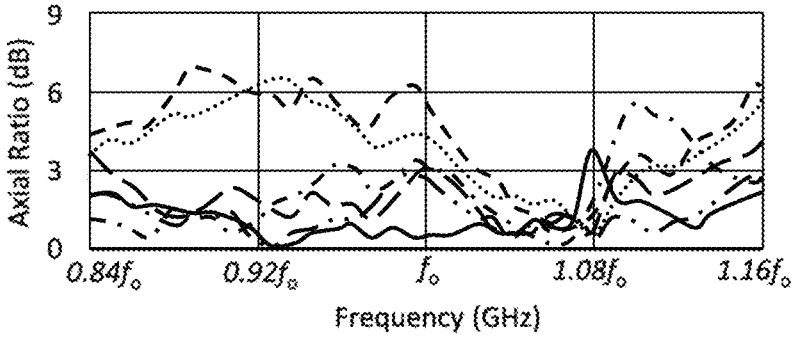

FIGS. 13A-13D are data plots showing the measured axial ratio (AR) versus frequency for both polarizations (LHCP and RHCP) and for the axial ratio bandwidth when the beam is scanned away from the broadside both elevation and azimuth cut planes for the embodiment of the phased array antenna 10 depicted in FIG. 4A. The measured three-dB AR bandwidth for scan angles up to ±30° is 24% for both cut-planes in this embodiment. Also regarding this embodiment, for both LHCP and RHCP polarizations on the azimuth cut plane, the axial ratio remains below 3 dB for scan angles up to ±45°. However, for both LHCP and RHCP in the elevation cut plane, in this embodiment, the axial ratio for +45° and −45° are degraded to around 6-7 dB, corresponding with expected simulated results, which can still be usable for some communication applications. FIG. 13A shows the LHCP AR azimuth scan. FIG. 13B shows the LHCP AR elevation scan. FIG. 13C shows the RHCP AR azimuth scan. FIG. 13D shows the RHCP AR elevation scan. In this embodiment, the operating frequency was 12.5 GHz.

From the above description of the phased array antenna 10, it is manifest that various techniques may be used for implementing the concepts of the phased array antenna 10 without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that the phased array antenna 10 is not limited to the particular embodiments described herein, but is capable of many embodiments without departing from the scope of the claims.

We claim:

1. A phased array antenna comprising:

a substrate;

a plurality of circular polarized wideband antenna elements (hereinafter referred to as elements) disposed on the substrate, wherein each element comprises two feeds that are orthogonal to each other in order to generate right-hand circular polarization (RHCP) and left-hand circular polarization (LHCP);

wherein the plurality of elements are organized into subarrays and physically oriented such that constituent elements of each subarray are sequentially rotated with respect to each other about respective element axes that are perpendicular to a surface of the substrate so as to allow RHCP and LHCP transmission and reception;

a phase shifter communicatively coupled to the feeds of all the elements and configured to electronically and dynamically compensate for phase regression or progression introduced by the sequential rotation of the elements without relying on physical transmission lines of different dimensions, wherein the phase shifter is further configured to introduce a progressive phase shift across a beam steering plane to enable beam steering of the phased array antenna.

2. The phased array antenna of claim 1, wherein all the subarrays are sequentially rotated with respect to each other about respective subarray center axes to create nested layers of rotation that reinforce circular polarization, wherein the subarray center axes are perpendicular to the surface of the substrate.

3. The phased array antenna of claim 1, wherein each subarray is triangular, consisting of three elements positioned with respect to each other as vertices of a triangle, wherein each constituent element of a given subarray is rotated by 120° about its element axis with respect to every other constituent element in the given subarray.

4. The phased array of antenna 3, wherein the triangular subarrays are arranged with respect to each other to form a lattice where each element that is not on an edge of the lattice forms a common vertex for six neighboring subarrays.

5. The phased array of claim 1, comprising six triangular subarrays disposed proximate to each other in a hexagon formation, wherein each given triangular subarray consists of three unique elements positioned with respect to each other as vertices of the given triangular subarray such that each of the three elements of the given triangular subarray is rotated by 120° about its element axis with respect to every other element in the given triangular subarray, and wherein each triangular subarray is rotated about a triangle centroid axis by 60° with respect to neighboring triangular subarrays in the hexagon formation.

6. The phased array of claim 5, wherein each element is a stacked patch antenna shaped as a square having two diagonally-opposite corners that are truncated.

7. The phased array of claim 2, wherein each constituent element of a given subarray has a different rotational orientation than every other constituent element in the given subarray.

8. The phased array of claim 5, wherein each element is a stacked patch antenna with a slot cut into a parasitic patch to excite circular polarization.

9. The phased array of claim 5, wherein each element is a stacked patch antenna comprising a driven patch that is electromagnetically coupled to a parasitic patch, wherein the driven patch is physically separated from the parasitic patch by a dielectric spacer, and wherein the driven patch and the parasitic patch have resonant frequencies that are close together such that the resonant frequencies overlap, in order to increase the impedance bandwidth.

10. The phased array antenna of claim 7, wherein each subarray is a 2×2 array consisting of four constituent elements that are sequentially and respectively rotated about their respective axes 0°, 90°, 180°, and 270°.

11. The phased array antenna of claim 10, wherein the subarrays are arranged into a 4×4 array consisting of four constituent subarrays that are sequentially and respectively rotated about respective subarray axes 0°, 90°, 180°, and 270°.

12. The phased array antenna of claim 1, wherein the progressive phase shift introduced across the beam steering plane by the phase shifter is determined according to $$\Delta\phi = \frac{360° * d * \sin\theta}{\lambda}$$

where $\Delta\phi$ represents the phase shift, d represents the space between elements, $\theta$ represents a beam steering angle, and $\lambda$ represents an operating wavelength.

13. The phased array antenna of claim 1, wherein the phase shifter is a fully integrated transmit/receive (T/R) chipset phase shifter.

14. The phased array antenna of claim 1, wherein the substrate is made of a closed-cell rigid expanded foam plastic based on polymethacrylimide.

15. A phased array antenna comprising:

a substrate;

a plurality of circular polarized wideband antenna elements (hereinafter referred to as elements) disposed on the substrate, wherein each element comprises two planar feeds that are disposed on the substrate and orthogonal to each other in order to generate right-hand circular polarization (RHCP) or left-hand circular polarization (LHCP), wherein each element has a center axis that is perpendicular to a surface of the substrate;

a feeder network coupled to the feeds;

wherein the plurality of elements is divided into first, second, and third subsets, wherein the first subset consists of elements that are rotated about their respective center axes by 0°, the second subset consists of elements that are rotated about their respective center axes by 120°, and the third subset consists of elements that are rotated about their respective center axes by 240°;

wherein the plurality elements is arranged in a lattice such that any triangular grouping of three neighboring elements in the lattice will include an element from the first, second, and third subsets such that RHCP or LHCP is enabled and reinforced both by the orthogonal feed disposition of each individual element and by the triangular groupings of elements that are each rotated by 120° with respect to each other;

a phase shifter communicatively coupled to the feeds through the feeder network such that each feed has an equal path length to the phase shifter, wherein the phase shifter is configured to electronically and dynamically compensate for phase regression or progression introduced by one or both of: any phase offset in the feeder network and the sequential rotation of the elements without relying on physical transmission lines of different dimensions, wherein the phase shifter is further configured to introduce a progressive phase shift across a beam steering plane to enable beam steering of the phased array antenna.

16. The phased array antenna of claim 15, wherein for any given triangular grouping of elements in the lattice, each triangular grouping that neighbors, and shares an element as a common vertex from, the given triangular grouping is rotated about a respective triangle centroid axis by 120° with respect to the given triangular grouping.

17. The phased array antenna of claim 15, wherein the progressive phase shift introduced across the beam steering plane by the phase shifter is determined according to $\Delta\phi=(360°*d*\sin\theta)/\lambda$ where $\Delta\phi$ represents the phase shift, d represents the space between elements, $\theta$ represents a beam steering angle, and $\lambda$ represents an operating wavelength.

18. The phased array antenna of claim 17, wherein the phase shifter is a fully integrated transmit/receive (T/R) chipset phase shifter.

19. The phased array antenna of claim 15, wherein each element is a stacked patch antenna shaped as a square having two diagonally-opposite corners that are truncated.

20. A phased array antenna comprising:

a substrate;

a plurality of circular polarized wideband antenna elements (hereinafter referred to as elements) disposed on the substrate, wherein each element comprises two feeds that are orthogonal to each other such that each element is able to generate circular polarized signals, thereby creating a first layer of rotation;

wherein the elements are arranged with respect to each other to form a lattice consisting of six triangular subarrays disposed proximate to each other in a hexagon formation, wherein each given triangular subarray consists of three unique elements positioned with respect to each other as vertices of the given triangular subarray such that each of the three elements of the given triangular subarray is rotated by 120° about its element axis with respect to every other element in the given triangular subarray thereby forming a second layer of rotation;

wherein each triangular subarray is sequentially rotated about a triangle centroid axis by 60° with respect to neighboring triangular subarrays in the hexagon formation thereby forming a third layer of rotation;

a phase shifter communicatively coupled to the feeds of all the elements and configured to electronically and dynamically compensate for phase regression or progression introduced by the sequential rotation of the elements without relying on physical transmission lines of different dimensions, wherein the phase shifter is further configured to introduce a progressive phase shift across a beam steering plane to enable beam steering of the phased array antenna.

* * * * *